US005868389A

United States Patent [19]

Kalivas

[11] Patent Number: 5,868,389

[45] Date of Patent: Feb. 9, 1999

[54] PORTABLE GAME BOARD

[76] Inventor: Christopher G. Kalivas, 29 Norton St., Patchogue, N.Y. 11722

[21] Appl. No.: 970,899

[22] Filed: Nov. 14, 1997

[51] Int. Cl.[6] ..... A63F 3/00

[52] U.S. Cl. ..... 273/286; 273/285; 273/287; 273/309

[58] Field of Search ..... 273/286, 285, 273/287, 260, 309

[56] References Cited

U.S. PATENT DOCUMENTS

| | | | |
|---|---|---|---|
| 821,881 | 5/1906 | Pell et al. | 273/286 |
| 1,127,594 | 2/1915 | Cooper | 273/286 |
| 1,422,450 | 7/1922 | Kositzky | 273/286 |
| 1,928,790 | 10/1933 | Luhn | 273/286 |

FOREIGN PATENT DOCUMENTS

| | | | |
|---|---|---|---|
| 1501915 | 10/1967 | France | 273/286 |

*Primary Examiner*—Benjamin H. Layno
*Attorney, Agent, or Firm*—Nolte, Nolte & Hunter

[57] ABSTRACT

A game board is made of a fabric sheet, printed with the game board design, and hemmed at two opposing edges. Two dowels are inserted through the hems. A pair of frame rails include pivotably mounted legs. Holes are provided in the frame rails for insertion of the dowels and for spreading the dowels approximately the length of the fabric sheet. The legs are pivotally mounted to frame rails by pins for storing the legs in a linear relationship with the frame rails, and for deploying the legs in a support attitude against the dowels.

4 Claims, 6 Drawing Sheets

PORTABLE GAME BOARD

The present invention relates to a game, and particularly to a game board adapted for use on a sandy beach.

BACKGROUND OF THE INVENTION

Various approaches to outdoor and to portable games have been utilized throughout the years, including pocket sized magnetic game boards, peg boards, and large permanent installations such as tiled or painted checker boards on outdoor tables, etc. Permanent installations may be unavailable in a given user's preference. Pocket sized boards are small. Conventional boards are poorly adapted to uneven beach sand surfaces, and sand gets on the playing surface.

BRIEF DESCRIPTION

The present invention provides a large scale portable game having pleasant tactile characteristics. The game is particularly well adapted to be carried to the beach and set up and played upon the sand. The present invention provides a stretched canvas playing surface hemmed around two dowels to provide opposing borders. The canvas is stretched between the dowels by a pair of plastic side beams. A third dowel provides a center support strut between the side beams and midway from the end dowels. The third dowel is secured to the side beams by elastic bands. Four legs pivot on the two side beams to an appropriate angle, where the dowels at the ends serve as stops. The legs are flat and thereby can be easily imbedded in the sand to provide anchoring against wind. The suspended board provides a stable platform which is largely independent of, and raised above, the irregularities of the sand.

The board can be colorfully printed upon the attractive canvas and playing pieces. Although light in weight, it can and be large and satisfying to use. The entire arrangement folds into a tubular sleeve. The sleeve is then inserted into a tubular drawstring duffel bag, also made of similar canvas to the board.

The entire package is attractive, lightweight, easy to carry, resistant to blowing away, and tactilely satisfying. Further, it has a look and feel consistent with other beach equipment, such as beach chairs, which further contributes to its attractiveness.

DETAILED DESCRIPTION OF THE DRAWINGS

Figure 1:
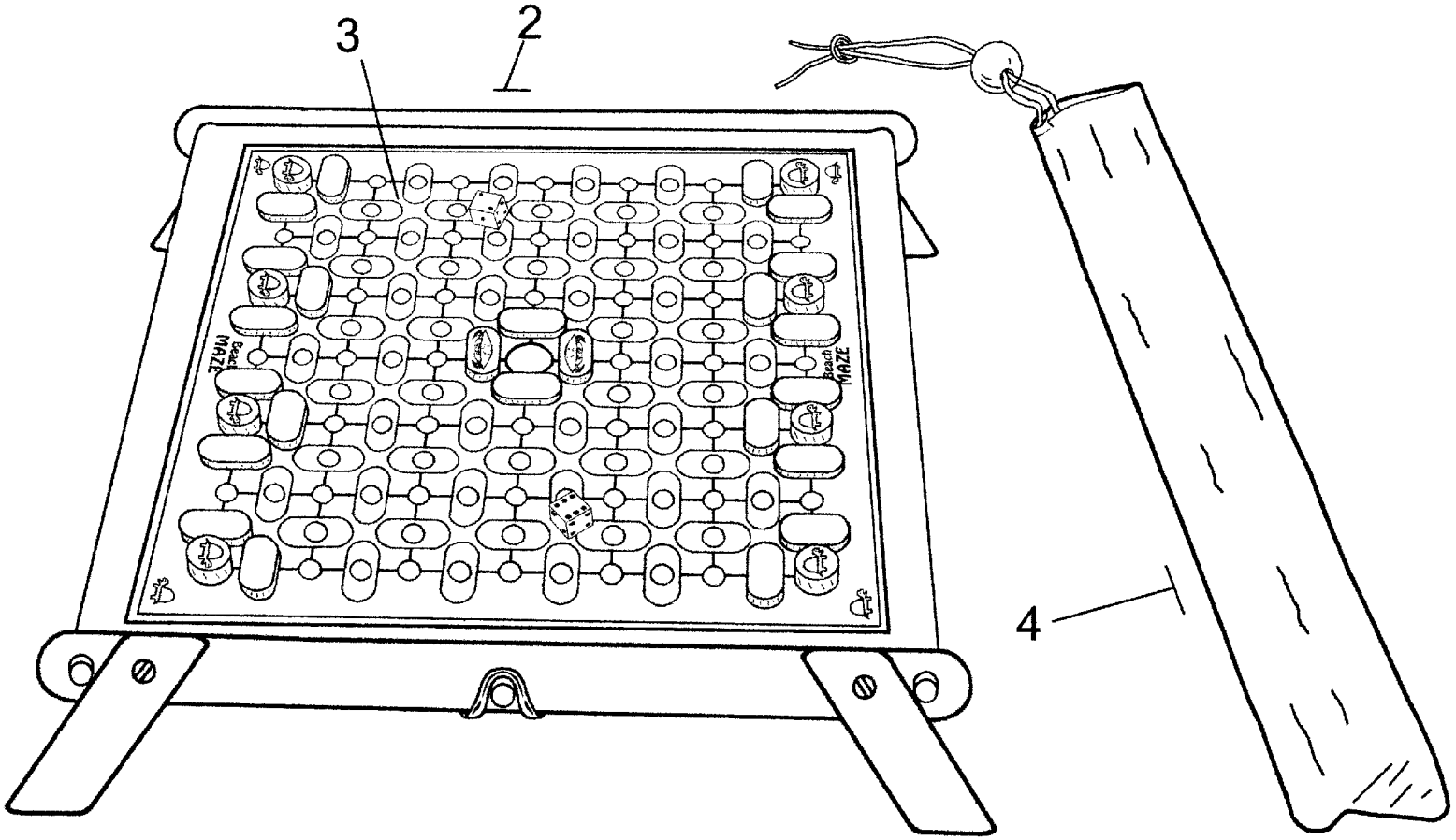
FIG. 1 is a perspective view of the board, setup, and with its duffel bag along side.

FIG. 1 shows a game board 2 with gamepieces 3 setup thereupon, sitting next to the duffel bag 4 that the game comes in.

Figure 2:
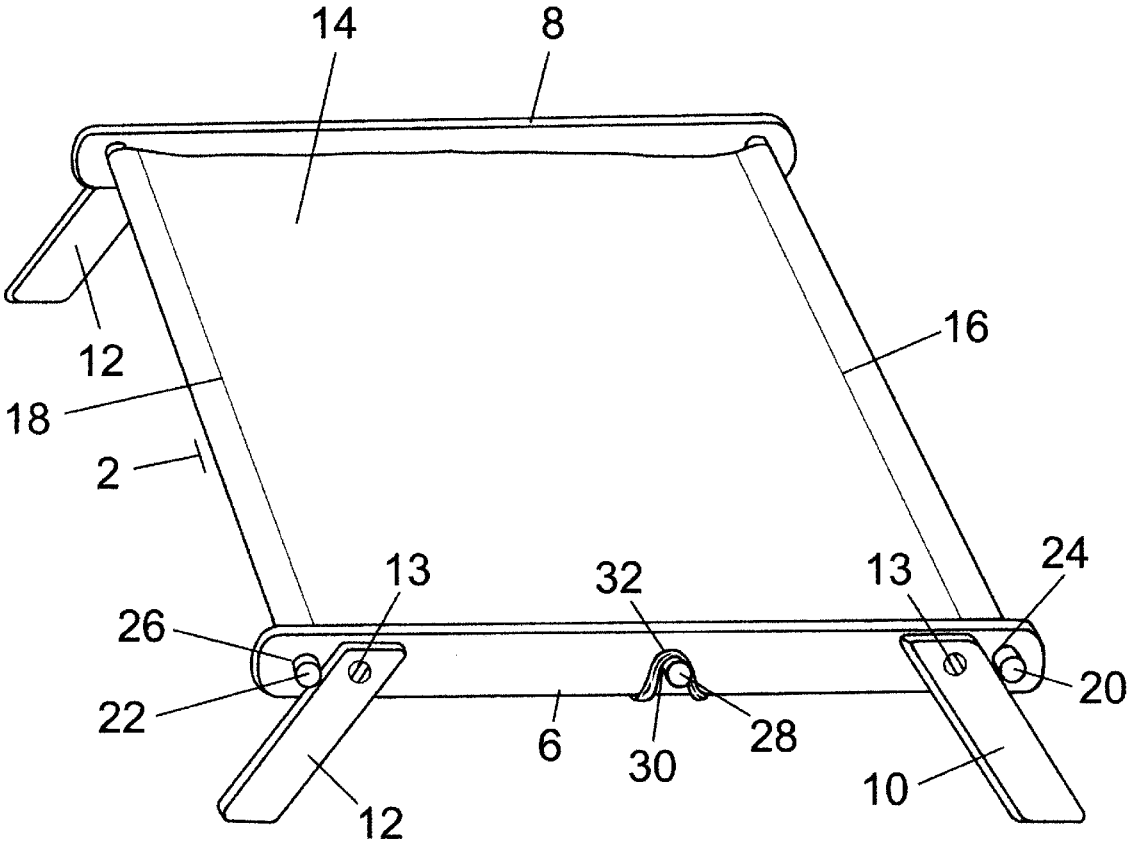
FIG. 2 is a similar view of the assembled board.
Figure 4:
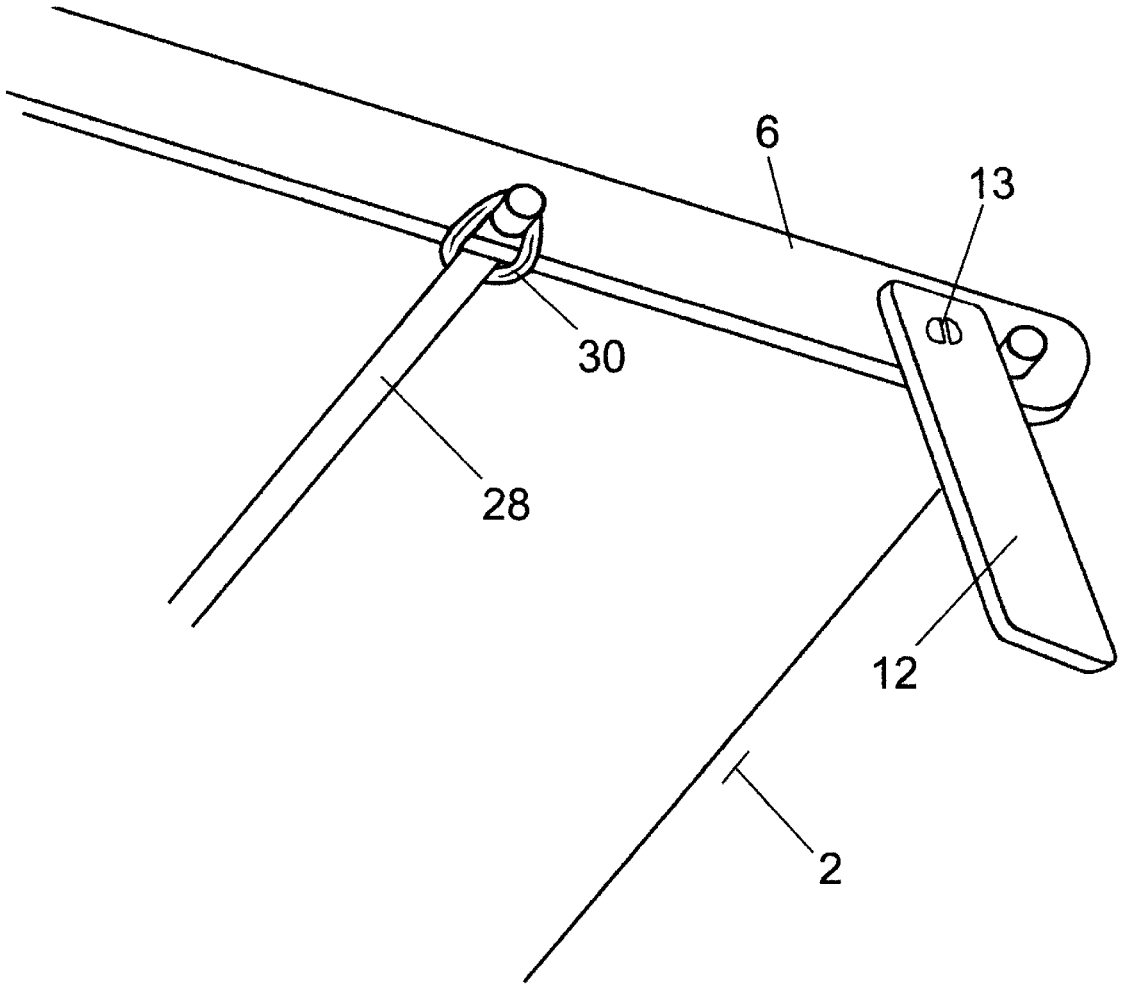
Figure 5:
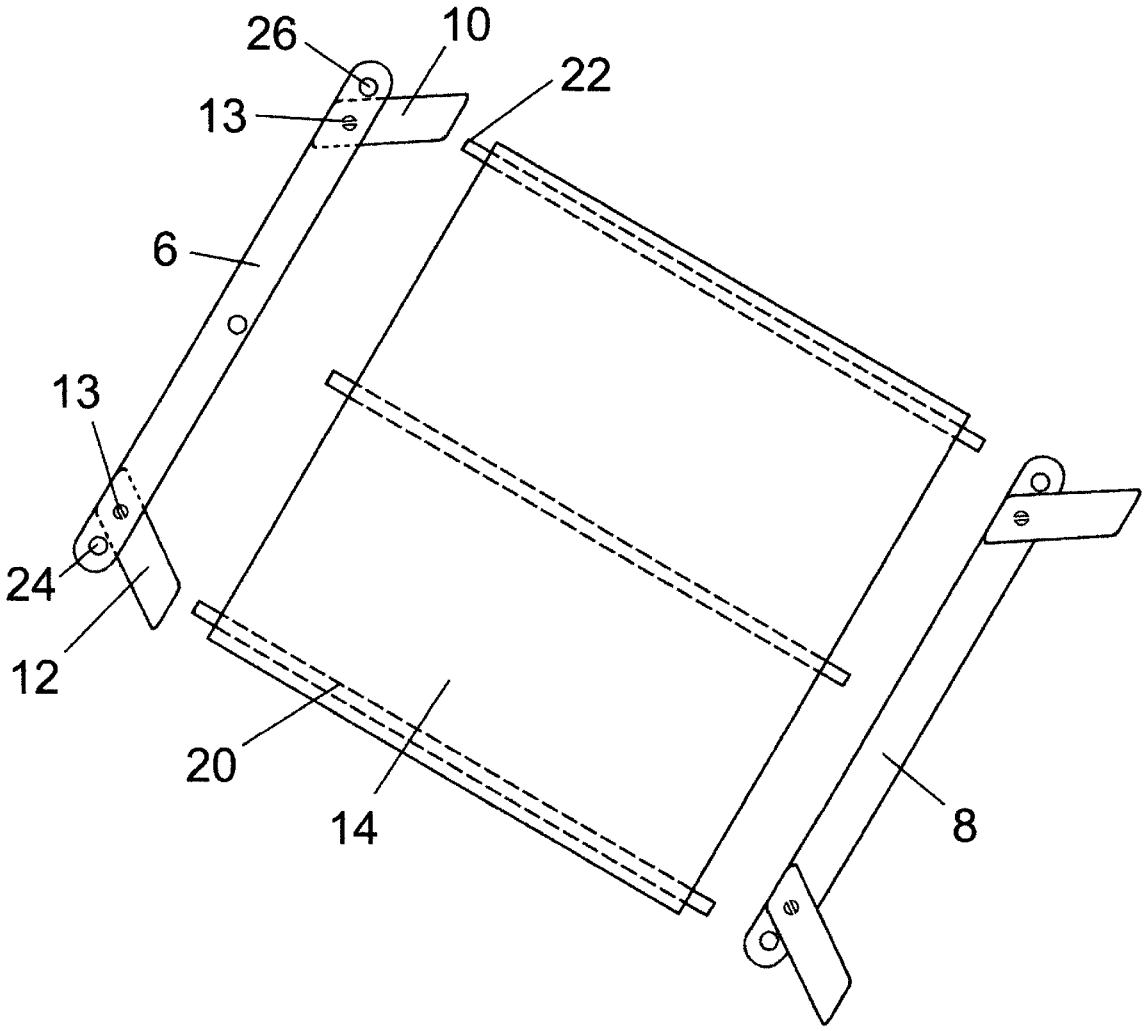
FIG. 5 is an exploded plan view of the game.

As in FIGS. 2 and 5, the game comprises a pair of frame rails 6 and 8. Pivotably pinned to each frame rail are two legs 10 and 12, pinned by pins 13. Canvas playing surface 14 comprises a pair of hems, 16 and 18 at each end through which a pair of dowels 20 and 22 are inserted. These dowels have ends tooled to a smaller diameter, ends which are inserted through holes 24 and 26 in frame rails 6 and 8. The dowels step where their larger diameter abuts holes 24, 26 in frame rails 6,8. A third dowel 28 is inserted through hole 30. As in FIG. 3, rubber-band 32 is placed on dowel 28 before insertion, and slipped around the frame rail 6 (FIG. 4), and over the end of dowel 28. This holds frame rails 6 and 8, which are similarly rubber-banded securely to dowel 28, and holds the entire structure together.

Figure 3:
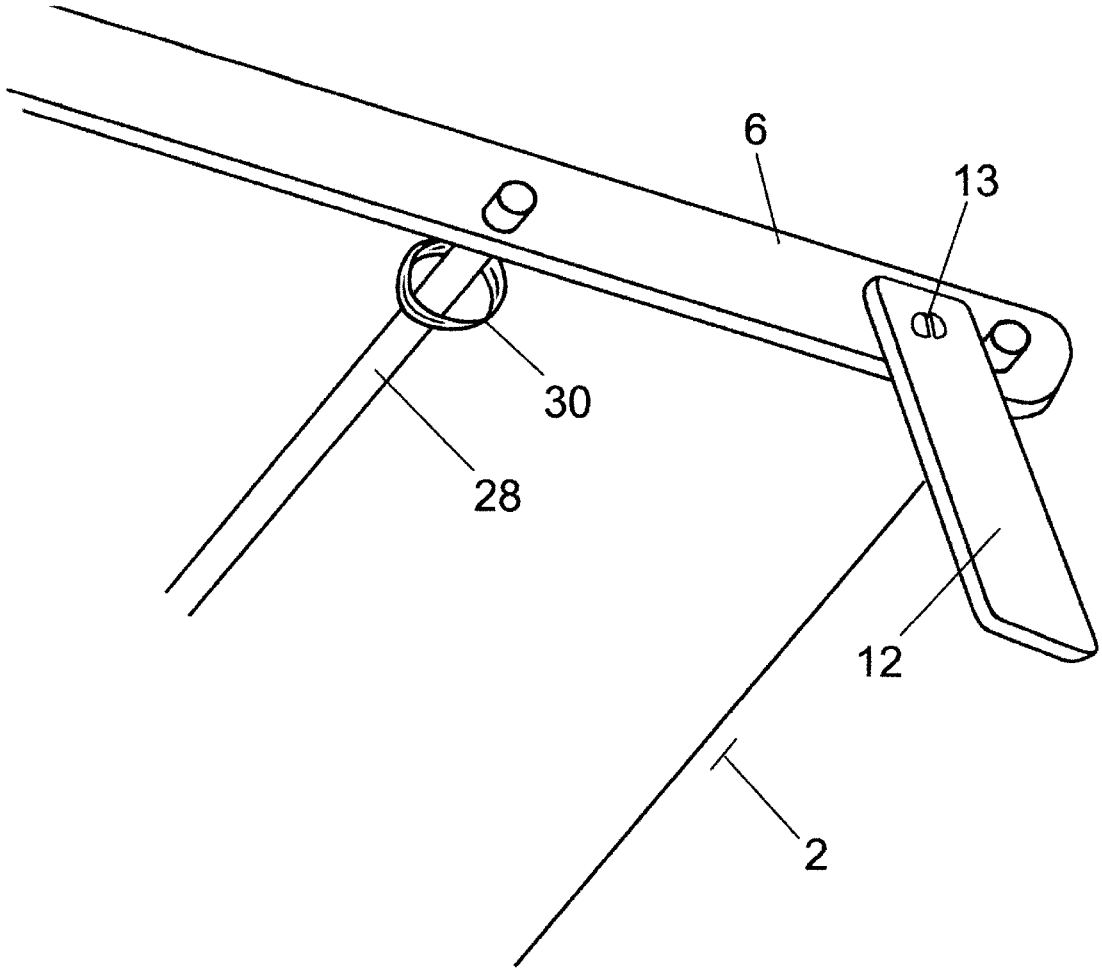
FIGS. 3 and 4 are partial perspective views of the board at various stages of assembly.

FIGS. 3 and 4 show the detail of how rubber-band 30 is assembled to dowel 28, and slipped over frame rail 6 as well as frame rail 8.

In FIG. 3, rubber-band 30 has been slipped over dowel 28 In FIG. 4, rubber-band 30 has been stretched around frame rail 6, and over the end of dowel 28 to secure the frame rail to the dowel.

FIG. 5 is an exploded view of the frame rails, dowels and canvas 14.

Figure 6:
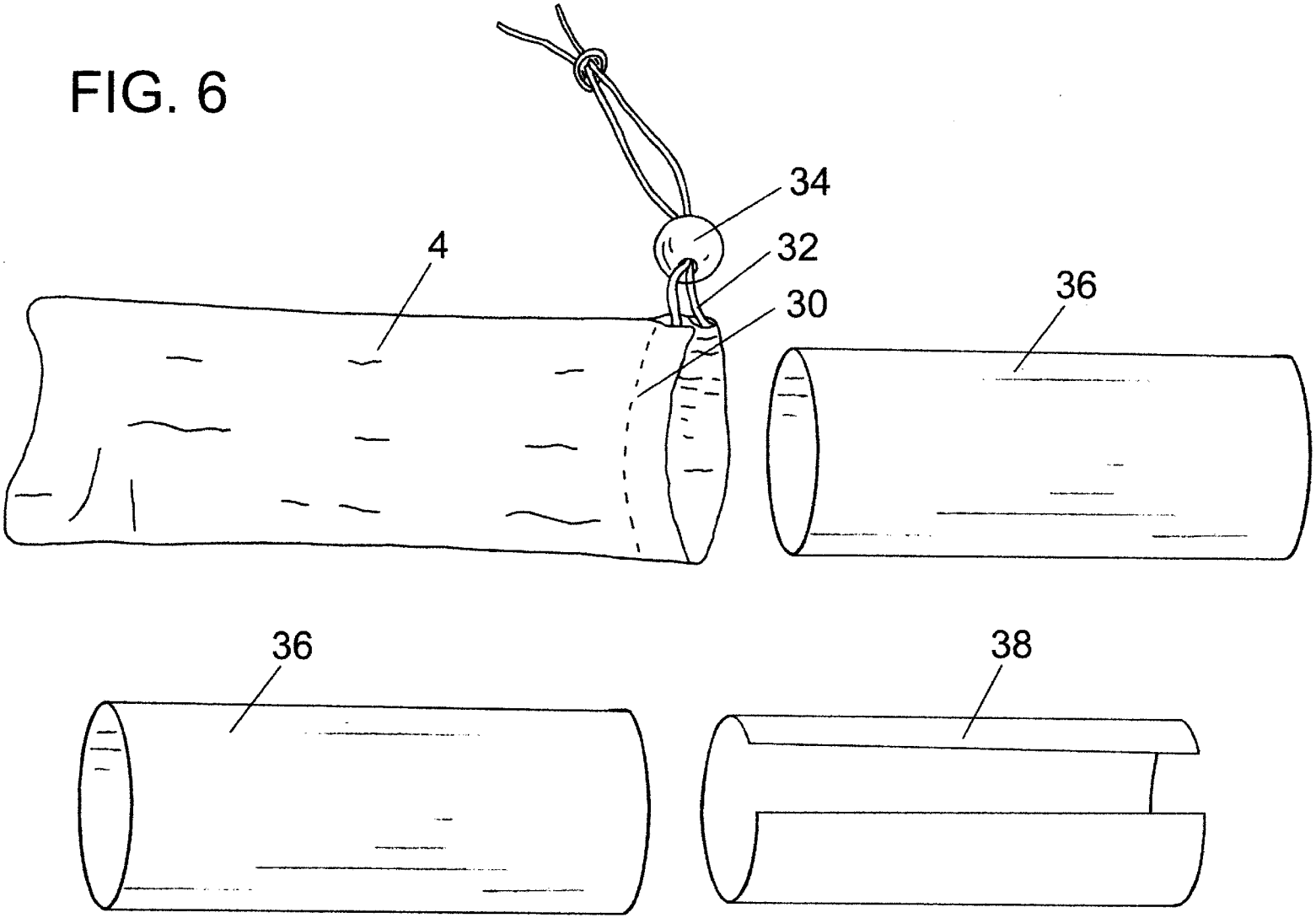
FIG. 6 is a perspective view of the cylinder and duffel.

FIG. 6 shows the various components of the duffel bag. A bag 4 comprises a hem 30 through which is slidably inserted a draw cord 32, and a draw cord lock 34, which is simply a wooden ball with a hole in it. Transparent sleeve 36 has been provided to prop open to the duffel bag and facilitates stuffing the game back in to the bag. Instruction sheet 38 can be rolled up and slipped into the transparent tube, and the remainder of the parts can be rolled and slipped inside the instructions. The entire tube can be then slid into the duffel bag, the draw cord lock 34 slid snug, drawing the drawstring to close the top of the bag, and thereby securing the parts within. Thus, an attractive canvas light-weight game bag is provided that can be easily transported to the beach.

Having just described my invention, I claim:

1. A game board comprising:

a fabric sheet, printed with the game board, and hemmed at two opposing edges to form two hems;

a plurality of dowels, two of which dowels are inserted through the hems;

a pair of frame rails comprising;

pivotably mounted legs, hole means for insertion of the dowels and for spreading the dowels approximately the length of the fabric sheet;

the legs pivotally mounted to frame rails by pin means for storing the legs in a linear relationship with the frame rails and for deploying the legs in a support attitude against the dowels.

2. A Game board according to claim 1, comprising:

a cooperatively sized cylindrical duffel bag as means for receiving, storing, and transporting the dissembled game board.

3. A game board according to claim 2 further comprising a rigid cylindrical sleeve as means for inserting the game board in a disassembled state in to the duffel bag.

4. A game board according to claim 3 comprising a draw string means for closing the duffel bag hemmed to an opening in the duffel and further comprising a draw cord lock.

* * * * *